United States Patent [19]

Stegmeier

[11] 4,216,761

[45] Aug. 12, 1980

[54] FIREPLACE AIR DISTRIBUTION SYSTEM

[76] Inventor: William R. Stegmeier, P.O. Box 373, Dayton, Ohio 45449

[21] Appl. No.: 921,431

[22] Filed: Jul. 3, 1978

[51] Int. Cl.[3] ..... F24B 1/18

[52] U.S. Cl. ..... 126/120

[58] Field of Search ..... 126/120, 121, 279

[56] References Cited

U.S. PATENT DOCUMENTS

| | | | |
|---|---|---|---|
| 578,240 | 3/1897 | Humphrys . | |
| 948,007 | 2/1910 | Doane | 126/120 |
| 978,227 | 12/1910 | Sholar | 126/120 |
| 996,703 | 7/1911 | Coyne | 126/120 |
| 1,558,848 | 10/1925 | Doble, Jr. . | |
| 1,640,771 | 8/1927 | Hannum . | |
| 1,915,826 | 6/1933 | Jensen . | |
| 2,093,492 | 9/1937 | Snyder . | |
| 2,789,554 | 4/1957 | Dupler . | |
| 2,969,787 | 1/1961 | Dupler . | |
| 3,685,506 | 8/1972 | Mouat . | |
| 3,820,527 | 6/1974 | Koch . | |
| 3,888,231 | 6/1975 | Galluzzo et al. . | |
| 4,004,731 | 1/1977 | Zung . | |
| 4,061,127 | 12/1977 | Fisher | 126/120 |

*Primary Examiner*—Samuel Scott
*Assistant Examiner*—Wesley S. Ratliff, Jr.
*Attorney, Agent, or Firm*—Biebel, French & Nauman

[57] ABSTRACT

A fireplace air distribution system includes a plurality of air feeder tubes extending from a manifold for installation through the back wall of a fireplace for bringing outside air through the manifold and tubes into the fireplace. The manifold includes a baffle for distributing the air evenly to the tubes for throttling the flow of air before it enters the tubes. This protects against wind gusts and reduces the discharge velocity of the air as it exits from the tubes into the fire.

3 Claims, 9 Drawing Figures

FIREPLACE AIR DISTRIBUTION SYSTEM

BACKGROUND OF THE INVENTION

This invention relates to fireplaces, and more particularly to an air distribution system for supplying air from outside the building structure to a fire within an interior fireplace. Systems containing general provisions for supplying outside air have been known for a long time, since it has long been recognized that it is more efficient to use unheated outside air to support the fire in the fireplace than to use heated room air.

Unfortunately, however, a great number of existing fireplaces, perhaps even the majority, have been constructed without outside air supplies. This is probably due to the historical cheapness of heating fuels, at least in the United States, so that the efficiency of a fireplace was not an important consideration. In fact, the fireplace in many cases was primarily for "atmosphere" rather than heat.

However, with the passing of the era of cheap fuel, has come a rekindled interest in wood as an alternative and renewable heat source. There is also a growing recognition that existing fireplaces would greatly benefit from efficiency-improving modifications. However, since they are masonry structures, they tend to be permanent, and thus difficult and expensive to modify except in relatively superficial ways. Asthetic considerations also limit the designer's freedom, lest his modifications produce something which no longer looks like a "fireplace".

Thus, many fireplaces are now being equipped with glass doors which substantially reduce the amount of air flow up the chimney from the room. Some fireplaces have also been equipped with heat extraction units within the fireplace for circulating warm air or water from the fireplace for heating the house. However, little has been done to provide outside air for supporting the combustion. The air for the fire continues to be drawn from the room itself, usually through small ports at the base of the glass door frame. Some fireplaces have pits connected to the outside for ash collection and removal, and some homeowners have opened these for supplying air. While this improves the efficiency of the fireplace, the blast of air through the pit creates a forge effect. This generates a hot spot in the middle of the fireplace which sometimes consumes the grate along with the logs.

A need thus remains for an inexpensive yet effective fireplace air distribution system for supplying air to a fire in a masonry fireplace from outside the building structure. Such a system should be readily suited for inexpensive and convenient installation in existing fireplaces, and should supply the outside air to the fire as needed without being affected by strong winds or gusts outside the building structure nor creating hot spots within the fireplace.

SUMMARY OF THE INVENTION

Briefly, the present invention meets the above needs and purposes with a fireplace air distribution system having a plurality of parallel, horizontal tubes for installation through the back wall of the fireplace. The tubes are connected to a manifold which is located behind the back wall of the fireplace. The manifold receives outside air and distributes it to the tubes which carry it through the back wall of the fireplace to the fire therein. A baffle within the manifold distributes the air evenly to each of the tubes and throttles the flow of air to protect against wind gusts and to reduce the discharge velocity of the air as it exits from the tubes into the fire. Thus, a gentle, uniform supply of air is fed to the fire, without a forge effect. The structure is uncomplicated, inexpensive, easy to install, and readily suited for installation in the majority of existing fireplace constructions.

It is therefore an object of the present invention to provide an improved fireplace air distribution system; an air distribution system which supplies air to a fire in a masonry fireplace from outside the building structure; which includes a plurality of tubes extending horizontally from a manifold for installation through the back wall of such a fireplace beneath the level of the fire or grate therein, and includes a baffle within the manifold for distributing air evenly to the tubes and throttling the flow of air thereto for controlling and reducing the discharge velocity of the air; which may also include a shutoff accessible from the fireplace for closing off the supply of outside air to the tubes when the fireplace is not in use; and to accomplish the above objects and purposes in an inexpensive, easily installed, durable and efficient configuration.

Other objects and advantages will be apparent from the following description, the accompanying drawings, and the appended claims.

Description of the Preferred Embodiment

Figure 1:
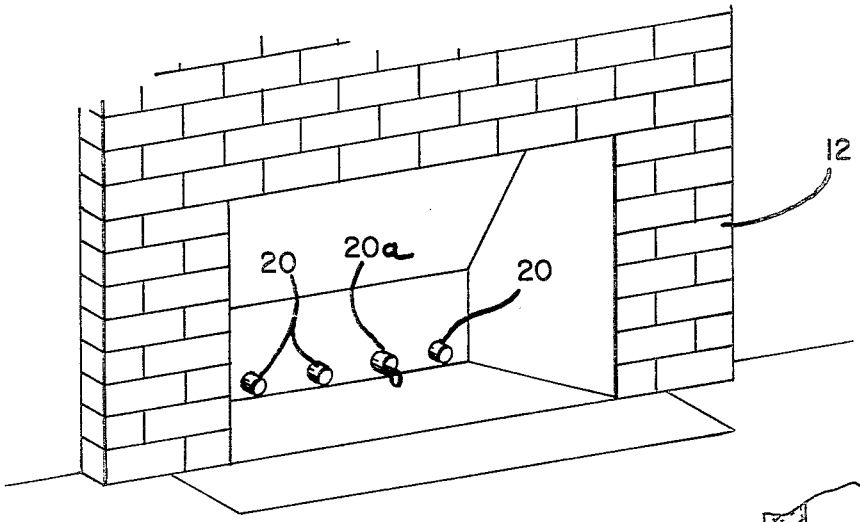
FIG. 1 is a perspective rendering of a masonry fireplace equipped with a fireplace air distribution system according to the present invention.
Figure 4:
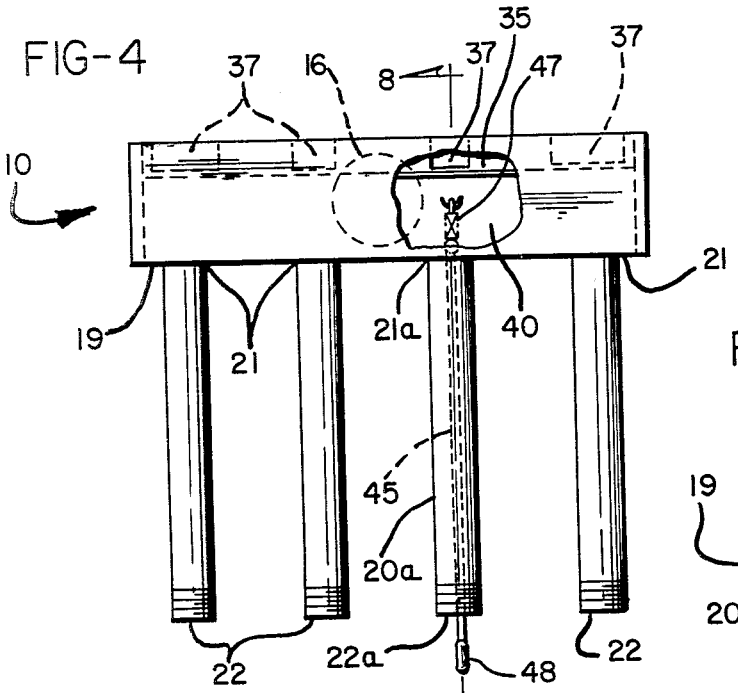
FIG. 4 is a partially broken away top view of the air distribution system showing the system in the open position.
Figure 5:
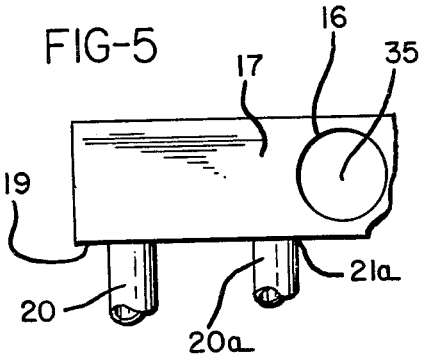
FIG. 5 is a fragmentary bottom view of the FIG. 4 system.
Figure 6:
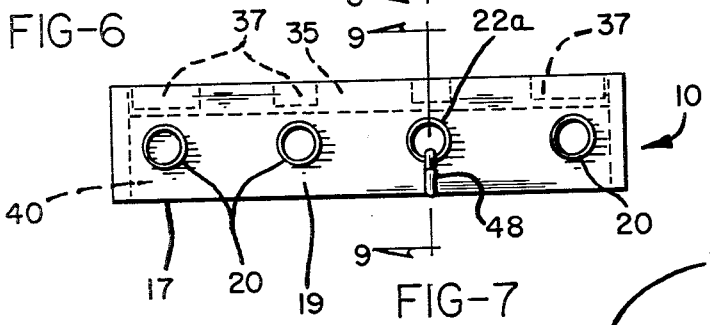
FIG. 6 is a front view of the FIG. 4 system showing the system in the closed position.
Figure 7:
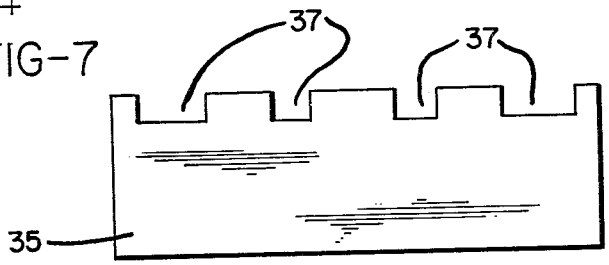
FIG. 7 is a plan view of the baffle plate of the air distribution system.

With reference to the drawings, FIG. 4 illustrates an air distribution system 10 which is designed for installation in an existing masonry fireplace 12 (FIG. 1) for supplying air to a fire therein from outside the building in which fireplace 12 is located. System 10 includes a manifold 15, which in this embodiment is an elongated metallic box outside and extending across substantially the width of the fireplace. Manifold 15 has an air inlet 16 on the bottom 17 thereof. On the front 19 of manifold 15 are mounted several air feeder tubes 20 having inlet ends 21 secured in and communicating with manifold 15 and outlet ends 22 opposite thereto.

Figure 2:
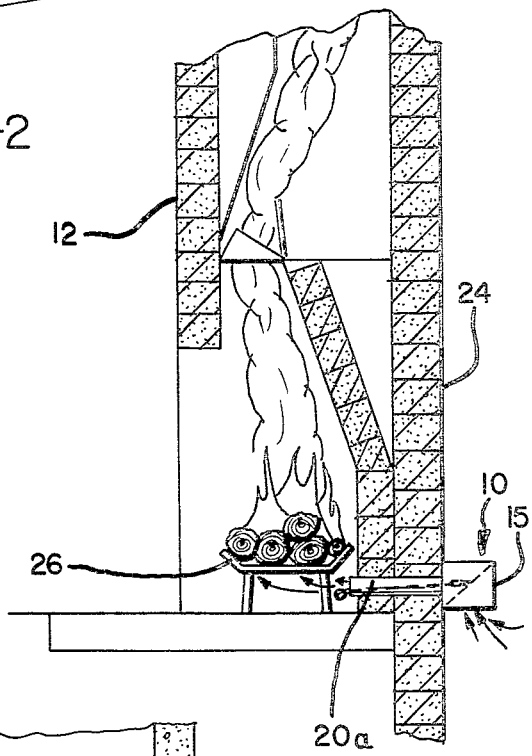
FIG. 2 is a cross-sectional side view of the FIG. 1 fireplace.

System 10 is installed through the back wall 24 of fireplace 12. When wall 24 is the exterior wall of the building, the manifold air inlet 16 will receive air directly from outside the building, as shown by the arrows in FIG. 2. The outside air then passes from the manifold into the tubes 20, and these supply the air through the back wall 24 of the fireplace to the fire therein, at a level beneath the level of the fire or of the grate 26 within the fireplace 12.

Ideally, the present invention will be incorporated in a fireplace as it is being constructed. However, it is also well-suited for easy retrofit into an existing fireplace. In the latter case, it is necessary only to chisel out several bricks in a row from the back wall 24, and several firebrick from the inside back of the fireplace, at the same level. The rest of the masonry stays in place without the need of additional reinforcement. The tubes 20 are then slid into the resulting slot from outside the building, and then mortared in place within the fireplace. Pieces of firebrick may be slipped between the tubes 20 before mortaring if desired. The outside brick does not need to be replaced.

Figure 3:
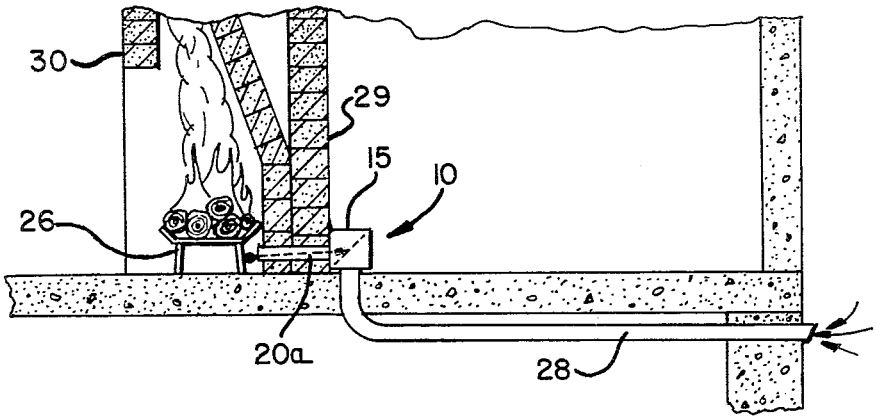
FIG. 3 is a cross-sectional view similar to FIG. 2 showing an installation for a fireplace contained centrally within a building.

FIG. 3 illustrates an alternative embodiment including an outside air conduit 28 for conducting outside air to the manifold air inlet 16 for a fireplace which is not on the outside wall of a building. In that case, the manifold 15 will again be installed on the back wall 29 of the fireplace 30 (FIG. 3), and although outside the fireplace itself, the manifold in this installation will be physically within the building.

Referring to FIGS. 4–9, the present invention includes several features which substantially improve its utility. As indicated, the air feeder tubes 20 make system 10 particularly suitable for convenient and inexpensive retrofit into existing masonry fireplaces. Their small size makes it easy to pass them through the back wall of the fireplace, and when installed, they are unobtrusive in appearance. However, small tubes of this type can act like air nozzles, which can produce a forge or "blast furnace" effect as the air blows upon the fire.

Figure 8:
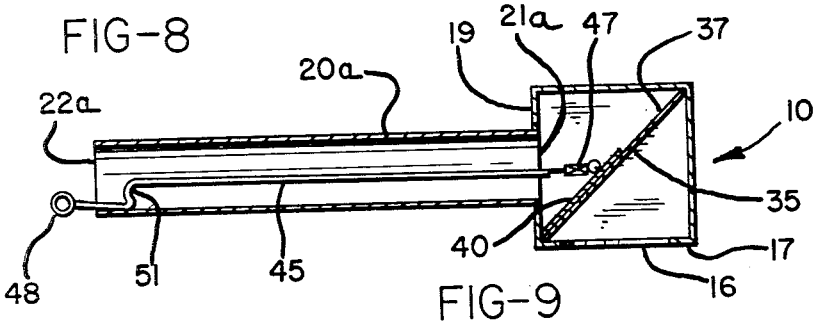
FIG. 8 is a cross-sectional view taken on line 8—8 of FIG. 4.
Figure 9:
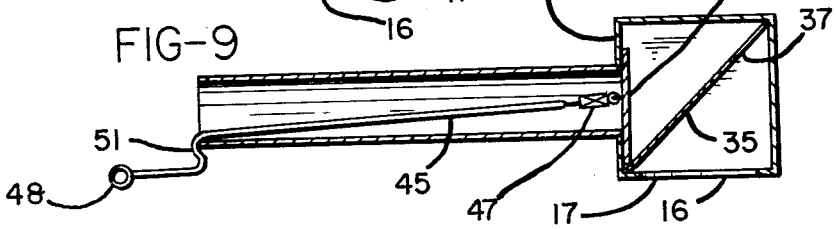
FIG. 9 is a cross-sectional view taken on line 9—9 of FIG. 6.

The present invention therefore includes a baffle plate 35 which is mounted angularly or diagonally within manifold 15 to slope upwardly and away from the tubes 20 (FIGS. 8 and 9). Baffle plate 35 includes several notches or air passages 37 located near the inlet ends 21 of the tubes 20 for regulating the supply of air thereto. Notches 37 are sized and spaced to supply substantially equal amounts of air to each of the tubes 20, and to throttle and regulate the flow of air thereto. Thus, the baffle plate 35, rather than tubes 20, is the flow restricter for the air distribution system 10. Accordingly, the pressure drop across the tubes 20 is nominal, resulting in low exit velocities and a gentle flow of air from the outlet ends 22 of the tubes 20. In other words, the major pressure drop is across the baffle plate notches 37, not the tubes 20. The baffle plate 35 and notches 37 also protect against wind gusts, for the same reason. Wind gust protection is further enhanced (see FIG. 2) by locating the manifold air inlet 16 on the bottom of the manifold 15, so it does not face into the wind as the wind blows against back wall 29 outside the building.

While the present invention substantially improves the efficiency of the fireplace when in use, it is also desirable to be able to turn the air supply off when the fire is out. Preferably the control for turning the air on and off should be readily accessible to the user. It should not be necessary, for example, to go outside the building to operate the air control.

To meet this need, the present invention includes a shutoff plate 40 which is located within manifold 15 above baffle plate 35 (FIGS. 8 and 9), and which in the open position rests freely upon baffle plate 35 (FIG. 8). When open, the air flow is thus into manifold 15 through the manifold air inlet 16, through the baffle plate notches 37, and into the inlet ends 21 of the tubes 20.

When the air flow is to be stopped, the shutoff plate 40 is pulled up and away from baffle plate 35, by a control line 45, to a closed position (FIG. 9). In the closed position the shutoff plate 40 lies across and blocks the inlet ends 21 of the air feeder tubes 20. A spring 47 in control line 45 tensions the control line to hold shutoff plate 40 firmly across the air feeder tube inlet ends 21.

Control line 45 extends through one of the air feeder tubes **20*a* from its inlet end 21*a* and out through its outlet end 22*a* where it can be positioned in the fireplace for ready access by the user. Line 45 may also have a hoop 48 on the end by which it can be engaged, for example, by a fireplace poker for pulling the line out to the closed position (FIG. 9) or releasing the line and moving it inwardly to the open position (FIG. 8). Line 45 may also have a bend 51 therein which can be hooked over the outlet end 22*a* of tube 20*a* for holding shutoff plate 40 in the closed position (FIG. 9**).

As may be seen, therefore, the present invention has numerous advantages. It is uncomplicated and inexpensive, yet highly durable and readily suited for use in virtually any existing or future masonry fireplace. It provides needed outside air to the fire at a gentle velocity which supports uniform combustion. It can be installed with minimum modifications to existing fireplaces, and is not objectional structurally or asthetically. The baffle plate not only provides a gentle and uniform supply of air to each of the air feeder tubes, but also helps protect against wind gusts, and in combination with the shutoff plate, provides an inexpensive and effective means for turning the air supply on and off. The placement of control line 45 in one of the air feeder tubes **20*a*** is also consistent with the unique design of the present invention which makes it particularly suitable for installation in existing fireplaces. Thus, a minimum amount of structural modification is required on the existing fireplace, yet the unit is fully and conveniently operable from the fireplace itself.

While the form of apparatus herein described constitutes a preferred embodiment of this invention, it is to be understood that the invention is not limited thereto, and that changes may be made therein without departing from the scope of the invention.

What is claimed is:

1. A fireplace air distribution system for supplying air to a fire in a masonry fireplace from outside the building structure, comprising:

(a) a manifold, (b) means for admitting air from outside the building into said manifold, (c) a plurality of air feeder tubes having inlet ends mounted and connected into said manifold and extending from said manifold for installation substantially horizontally through the back wall of the fireplace beneath the level of the fire or grate therein to supply the outside air from said manifold to the fire, (d) perforated baffle plate means disposed angularly within said manifold to slope upwardly away from said tubes for distributing the air evenly to each of said tubes and for throttling the flow of the air to protect against wind gusts and to reduce the discharge velocity of the air as it exits from said tubes into the fire, (e) shutoff means within said manifold for shutting off the supply of air from said manifold into said tubes, (f) control means for operating said shutoff means from outside said manifold, and (g) said shutoff means including a shutoff plate disposed between said tubes and said baffle plate and adapted to be moved by said control means between a closed position in which it lies across and blocks the inlet ends of said tubes, and an open position wherein said shutoff plate rests upon said baffle plate away from the inlet ends of said tubes and does not block the flow of air into said tubes from said manifold.

2. The system of claim 1 wherein said control means further comprises a control line attached to said shutoff plate for pulling said shutoff plate up and away from said baffle plate and across said tubes to shut off the supply of air therethrough, said control line extending through the outlet end of one of said tubes for positioning in the fireplace, and means on the fireplace end of said control line for engaging said control line to pull said shutoff plate from said open to said closed position.

3. A fireplace air distribution system for supplying air to a fire in a masonry fireplace from outside the building structure, comprising:

(a) a manifold extending across substantially the width of the fireplace, (b) means forming an air inlet opening through the bottom of said manifold for admitting air from outside the building into said manifold, (c) a plurality of substantially parallel air feeder tubes having inlet ends mounted in said manifold and extending from said manifold for installation substantially horizontally through the back wall of the fireplace beneath the level of the fire or grate therein to supply the outside air from said manifold to the fire, (d) a perforated baffle plate disposed angularly within said manifold to slope upwardly away from said tubes for distributing the air evenly to each of said tubes and for throttling the flow of the air to protect against wind gusts and to reduce the discharge velocity of the air as it exits from said tubes into the fire, (e) a shutoff plate within said manifold between said tubes and said baffle plate and adapted to be moved between a closed position in which it lies across and blocks the inlet ends of said tubes for shutting off the supply of air from said manifold into said tubes, and an open position away from the inlet ends of said tubes in which the flow of air into said tubes from said manifold is not blocked by said plate, said shutoff plate resting upon said baffle plate in said open position, and (f) a control line having tension means therein and attached to said shutoff plate for pulling said shutoff plate up and away from said baffle plate and holding said shutoff plate under tension across said tubes to shut off the supply of air therethrough, said control line extending through the outlet end of one of said tubes for positioning in the fireplace, and means on the fireplace end of said control line for engaging said control line to pull said shutoff plate from said open to said closed position.

* * * * *